United States Patent [19]

Shibuya et al.

[11] Patent Number: 4,697,321

[45] Date of Patent: Oct. 6, 1987

[54] METHOD OF MANUFACTURING BAFFLES FOR SHELL AND TUBE TYPE HEAT EXCHANGERS

[75] Inventors: Hisao Shibuya, Kunitachi; Tsunero Yusa, Chiba, both of Japan

[73] Assignee: Kamui Company Ltd., Japan

[21] Appl. No.: 851,238

[22] Filed: Apr. 14, 1986

Related U.S. Application Data

[62] Division of Ser. No. 761,380, Jul. 31, 1985, Pat. No. 4,614,105.

[51] Int. Cl.[4] ..... B21D 53/00; B23P 15/26

[52] U.S. Cl. ..... 29/157.3 R; 29/157.3 A; 29/157.3 AH; 29/727

[58] Field of Search ..... 29/157.3 R, 157.3 AH, 29/157.3 A, 157.3 D, 157.4, 400 D, 726, 727, 526 A; 165/182, 183, 184

[56] References Cited

U.S. PATENT DOCUMENTS

| | | | |
|---|---|---|---|
| 2,070,539 | 2/1937 | Muhleisen | 165/182 |
| 2,460,024 | 1/1949 | McKee | 29/157.3 AH |
| 2,693,942 | 11/1954 | Guala | 29/157.4 |
| 2,760,255 | 8/1956 | Compton | 29/157.3 AH |
| 3,400,758 | 9/1968 | Lee | 29/157.3 AH |
| 4,360,059 | 11/1982 | Funke | 165/184 |

*Primary Examiner*—Howard N. Goldberg
*Assistant Examiner*—Irene Graves Golabi
*Attorney, Agent, or Firm*—Marvin E. Jacobs

[57] ABSTRACT

A helical baffle for shell and tube type heat exchangers is fabricated by stamp forming a plate in the form of a partial circular section into a helical section between opposed, mating helically-shaped faces of two forming dies. The plate contains a series of apertures in the form of a pattern for receiving heat exchanger tubes. The dies contain sleeves and opposed reaming rods which form lips on the apertures during stamping of the plate. Lips can also be formed on the outer edge of the plate and the edge of a central passage during stamping. The lips prevent the helical plate from twisting or returning to a flat configuration. The leading and trailing edge of the helical plates are then joined such as by rivetting or welding into a continuous helical baffle with sets of heat exchanger tube apertures aligned along a common axis.

8 Claims, 13 Drawing Figures

METHOD OF MANUFACTURING BAFFLES FOR SHELL AND TUBE TYPE HEAT EXCHANGERS

This is a division of application Ser. No. 761,380, filed July 31, 1985, now U.S. Pat. No. 4,614,105.

TECHNICAL FIELD

The present invention relates to the manufacture of baffles and, more particularly, this invention relates to the manufacture of helical baffles for shell and tube type heat exchangers by a stamp forming technique.

BACKGROUND ART

This invention deals with a method of manufacturing helical baffles which support multiple tubes in shell and tube type heat exchangers. It is a known practice to place baffles within the bundle of a shell and tube type heat exchanger in order to force the shellside fluid to flow across tubes thereby increasing the efficiency of heat exchange between tubeside fluid and shell-side fluid.

There are many types of baffle configurations. The most popular type is the plate in the form of a segmented circle. The segmental baffles are arranged so that the segmented section faces are disposed opposite to each other along a bundle of tubes at specified interval, thereby causing the shellside fluid to snake through the bundle of tubes crossing the tubes in a direction perpendicular to the axis of the tubes. The amount of cut of the segmental baffles is determined by considering the shellside fluid velocity and volumetric flow rate. The shellside fluid flows through the baffle cut area by reversing the direction 180 degrees at each baffle edge, resulting in pressure loss at every turn of flow at a baffle edge. Another shortcoming of segmental baffles is the existence of a stagnant region of flow created at each corner between the baffle and the shell, resulting in inefficient heat transfer.

Heat exchangers disclosed in Japanese Patent Application No. S48-65547 (published) and Utility Patent No. S55-73190 (published) feature helical baffle plates which can be shaped so that the fluid flows smoothly along the helical channel, resulting in substantial reduction of pressure loss and at the same time giving very high heat transfer efficiency because of the absence of stagnant region of fluid in the exchanger. This is a particularly desirable feature of heat exchangers for high viscosity oil. However, the heat exchangers, incorporating such helical baffles to form single or multiple continuous helical passages, are presently manufactured by casting the helical baffles and the center pipe together for small size exchangers or for larger size by connecting cast pieces of appropriate length of helical baffle and center piece in series. This requires extensive manufacturing facilities including casting facilities and casting dies. The cast products are also inherently thick, thus wasting substantial amounts of material. This invention is made to solve the above mentioned short comings and to offer the method of manufacturing helical baffles of any size at substantially reduced cost.

STATEMENT OF THE INVENTION

Specifically, this invention deals with a method of manufacturing baffles for shell and tube type heat exchangers by stamp-forming a circular plate containing prepierced base holes. The plate has a peripheral length less than a full circle. The plate is formed into a section of helical plate by sandwiching the plate material between two forming dies and simultaneously reaming the said prepierced base holes into supporting tube holes through which exchanger tubes are passed. Thus, manufactured helical baffles are connected to one another in series along the outer periphery of a center pipe thereby forming a continuously coiled passage for fluid in the exchanger.

These and many other features and attendant advantages of the invention will become apparent as the invention becomes better understood by reference to the following detailed description when considered in conjunction with the accompanying drawings.

DETAILED DESCRIPTION OF THE INVENTION

Figure 1:
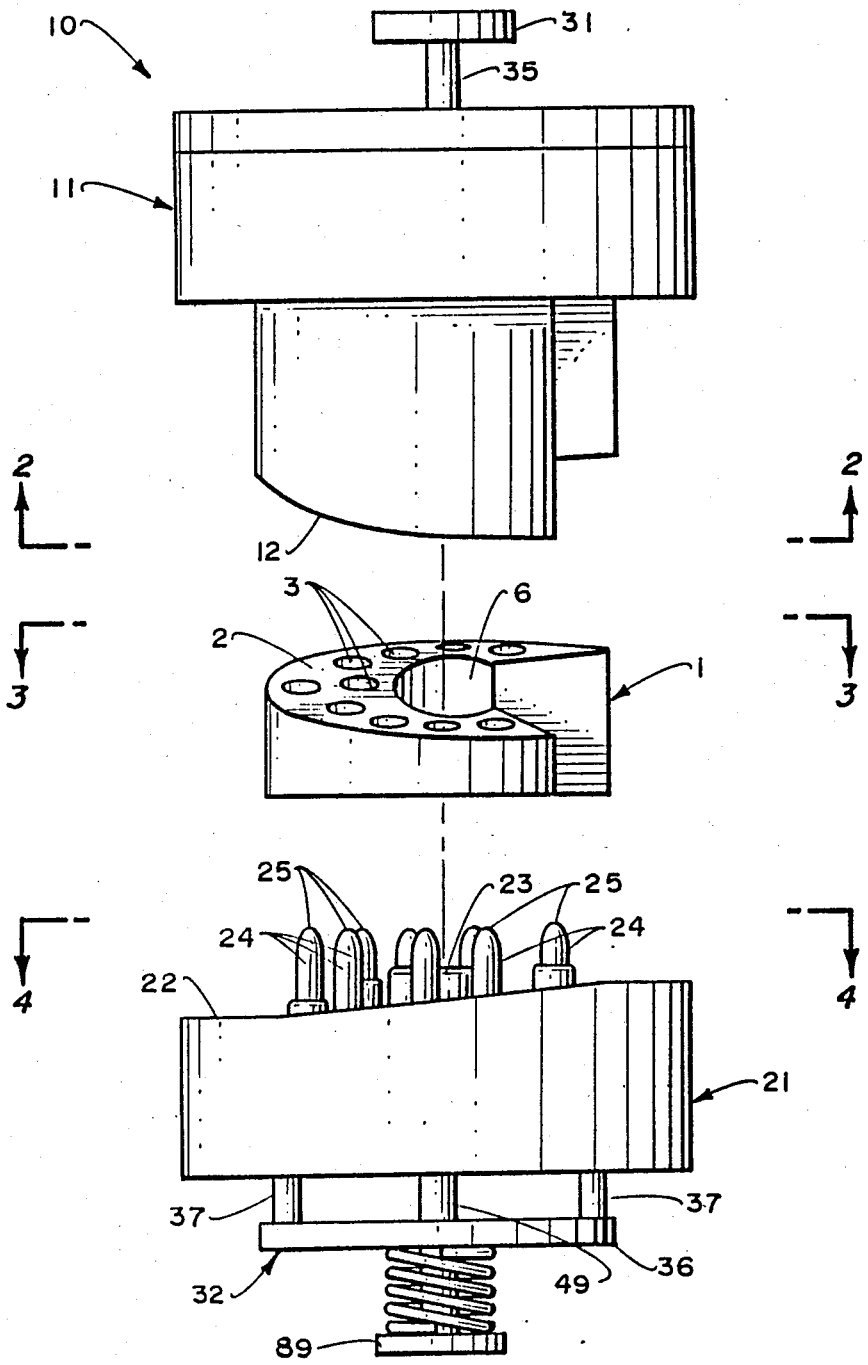
FIG. 1 is a front exploded view of the baffle forming apparatus of the invention.
Figure 2:
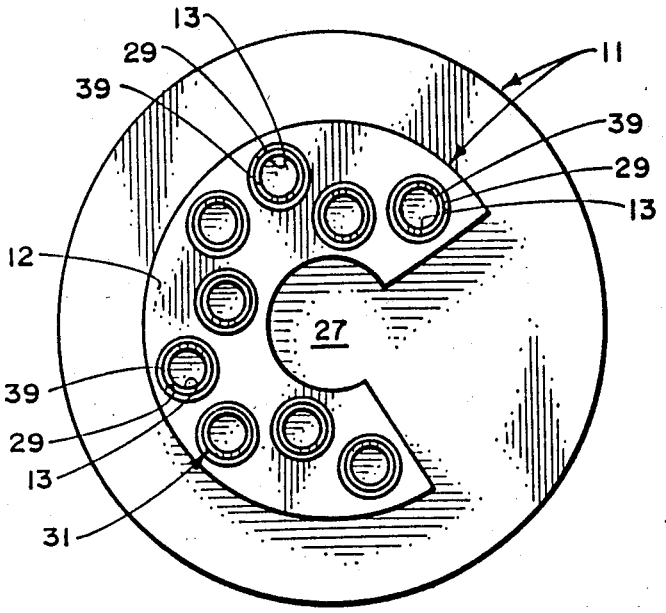
FIG. 2 is a bottom view of the upper die taken along line A—A of FIG. 1.
Figure 3:
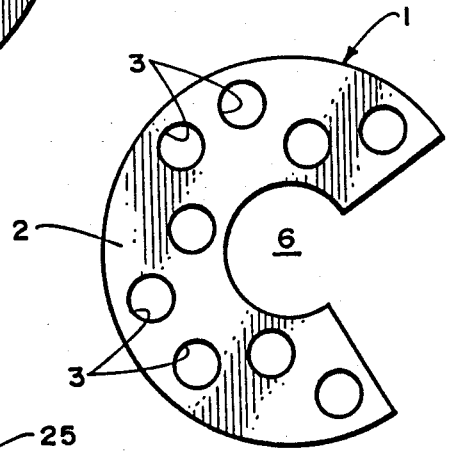
FIG. 3 is a top view of the lower forming die taken along line B—B of FIG. 1.
Figure 4:
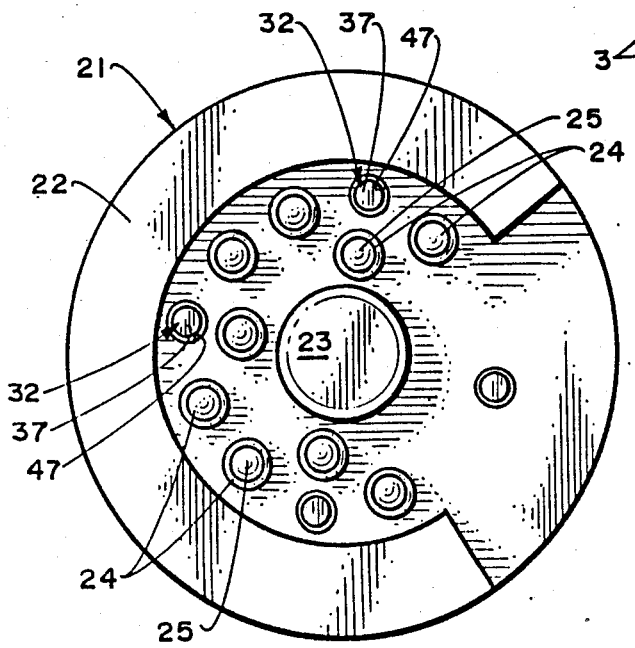
FIG. 4 is a top view of the die guide taken along line C—C of FIG. 1.

Helically-shaped baffles for shell and tube type heat exchangers are provided according to the invention by stamp forming a plate prebored with a set of apertures for receiving the heat exchanger tubes into a section of a helical baffle. The stamp forming is conducted in a manner to form lips on the prebored apertures and on the inner and outer edges of the plate. The lips which are perpendicular to the surface of the helical baffle section maintain the section in helical form, preventing the section from reassuming a flat configuration. The sections are joined by rivetting, welding or other technique around a central conduit to form a helical baffle with the tube holes aligned. The heat exchanger tubes are then inserted into the baffle. The baffle-tube assembly is then inserted into the shell and the end bonnets installed to complete fabrication of a heat exchanger.

The manufacturing process is extremely simple and much less expensive than the casting process. Only two steps are required. A plate is first bored with a preset pattern of apertures. In a second step, the plate is press formed into a section of a helix and simultaneously reamed to provide supporting lips on the edges of the plate and of the apertures. The process of the invention is capable of manufacturing baffle plates of any size, large or small, in an inexpensive and simple manner.

Referring now to FIGS. 1–4, the forming tool assembly 10 consists of a lower forming die 1, upper forming die 11 and the die guide 21. The die guide 21 contains a plurality of guide rods 24 which terminate in rounded tapered top ends 25 having a reduced diameter. The die guide 21 also contains a central cylindrical stud 23 of a diameter corresponding to the central conduit of the heat exchanger. The lower forming die 1 contains a plurality of cylindrical, guide rod passages 3 corresponding in location to the guide rods 24. The lower forming die 1 also contains a central hole 6 of the same diameter and in registration with the stud 23. The upper, inclined face 2 is in the form of partial cylinder or a segment of a cylinder such as 180° to 340° of a full curcle, usually 270° having a circumference three-fourths the length of the full circumference of a circle. Such a plate has a one-fourth pie-shaped section removed. The cavity 7 of the die guide 21 has a diameter slightly larger than the diameter of the outer surface of upper forming die 1. The lower forming die 21 has an upper face 2 inclined at an angle or pitch corresponding to that of the helical baffle to be formed. The lower forming die 1 is received in the cavity 7 in the die guide 21 with the guide rods 24 loosely received in the guide passages 3 and the stud 23 tightly received in the central hole 6.

The upper forming die 11 has a lower inclined face 12 parallel to the inclined face 2 of the lower die 1. The die 11 has a series of apertures 13 in registration with the guide rods 24 and of a diameter larger than the rods 24. The die 11 also contains a central cylindrical recess 27 larger in diameter than the stud 23. The apertures 13 connect to an upper cavity 29. A plunger 31 having a plate 33 is received in the cavity 29. The plunger 31 has an upper stem 35 connected to the plate 33 received in a central passage 37. A series of plunger legs 39 received in each aperture 13 are also connected to the plate 33. The die guide 21 also has a stem 49 with end plate 39 on which is mounted a spring and a plunger 36 having arms 37 received in passages 47 which communicate the arms in contact with the base of the die 1.

Figure 6:
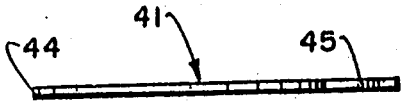
FIG. 6 is a front view of the plate material.
Figure 5:
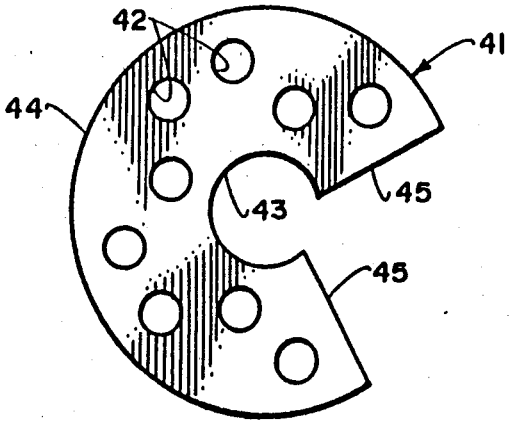
FIG. 5 is a top view of the prepierced plate material.

Referring now to FIGS. 5 and 6, a metal plate 41 for forming the helical baffle section is illustrated. The plate 41 contains a series of apertures 42 in the pattern of the tubes of the heat exchanger bundle but having a diameter smaller than the tubes by a predetermined amount equal to the height of a lip 55 to be formed. The plate is in the form of a cylindrical section having a circumferential length exceeding that of the die 1 by an amount equal to the end edges 45. The outer diameter of the annular shaped plate 41 exceeds the diameter of die 1 by the height of the outer lip 44 and the inner diameter is less than that of the stud 23 by an amount equal to the lip 43.

Figure 7:
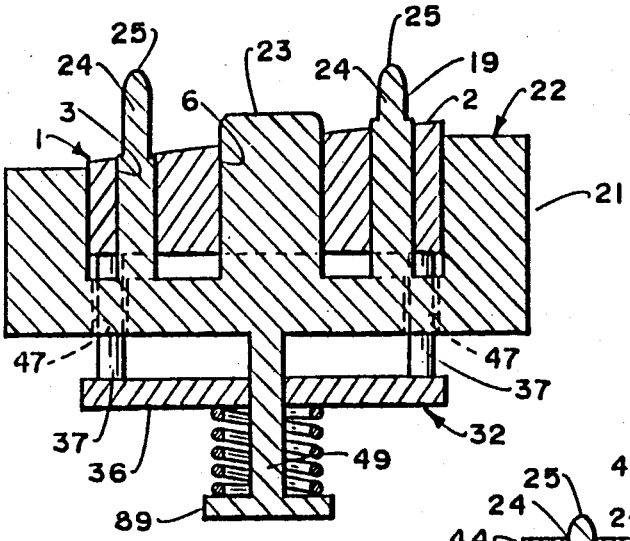
FIG. 7 is a cross-sectional view of the assembled guide and lower forming die.
Figure 8:
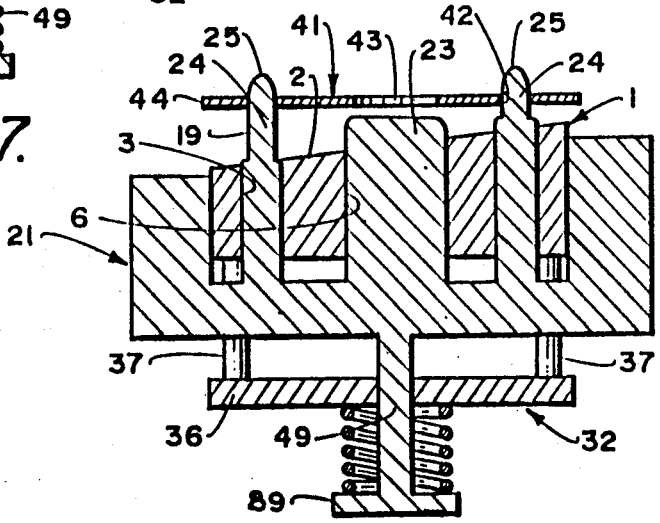
FIG. 8 is a cross-section of the assembly of the guide and lower die with the plate inserted.
Figure 9:
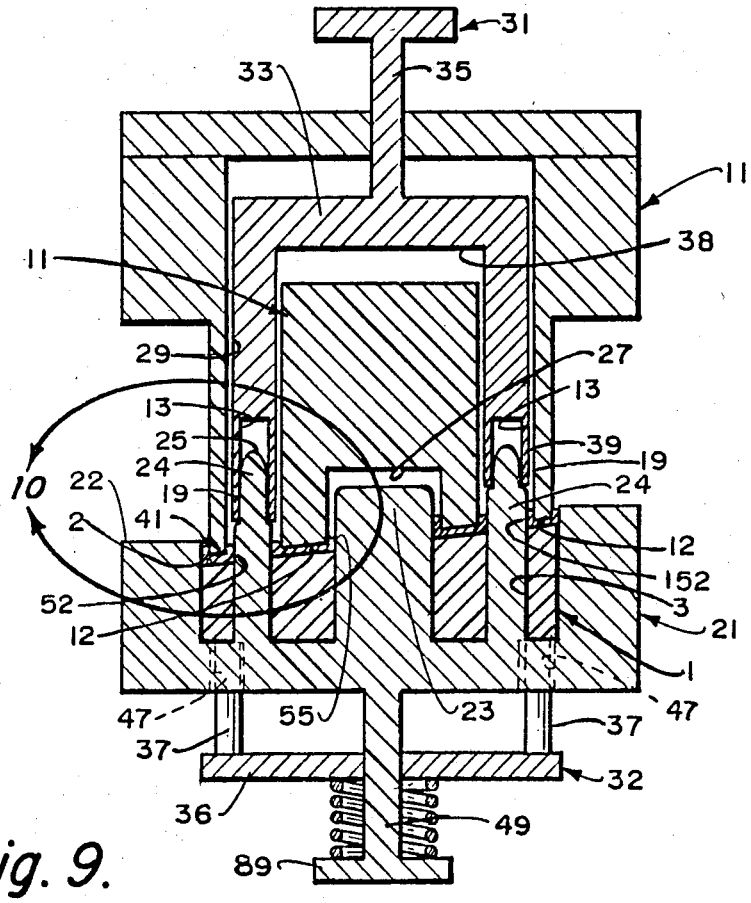
FIG. 9 is a cross-sectional view of the assembly of FIG. 8 further showing the positioning of the upper forming die.

The baffle forming process is illustrated in FIGS. 7–10. As shown in FIG. 7, die 1 is placed in the die guide 21. The spring biasing the arms 32 of the plunger 32 upwardly raises the lower die 1 slightly within the cavity. The guide rods 24 extend above the inclined face 2. As seen in FIG. 8, the plate 41 is then placed on the guide rods 24 with the smaller diameter tapered end 25 penetrating each of the apertures 42. The tapered end 25 enters a corresponding sleeve 17 in the legs. The legs seat on the outer upper edge 19 of the rods 24 and seat the lower die 1 in the cavity in the die guide. As the upper die 11 and lower die 1 are brought together, they sandwich the plate 41 between the mutally opposed mating inclined faces, 2, 12 and convert the plate into a helix of predetermined pitch, as shown in FIG. 9. During the stamping step, the apertures 52 in the plate 41 are reamed as they pass over the tapered ends 25 of the guide rods 24 to bend the excess materially upwardly to form a perpendicular lip 55 surrounding a tube hole whose cross-section in a plane perpendicular to the axis of the helix is a true circle.

Figure 10:
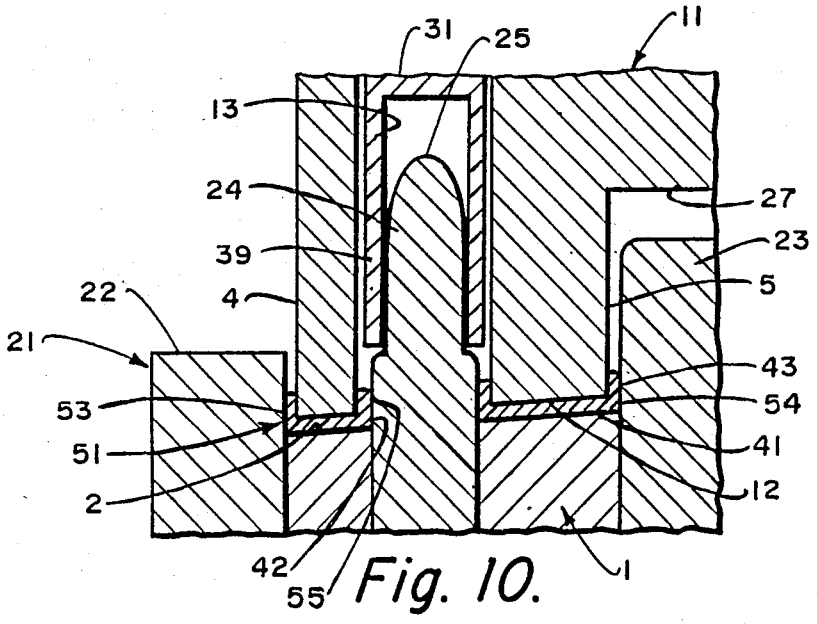
FIG. 10 is an exploded view in section of a detail of the assembly of FIG. 9.
Figure 11:
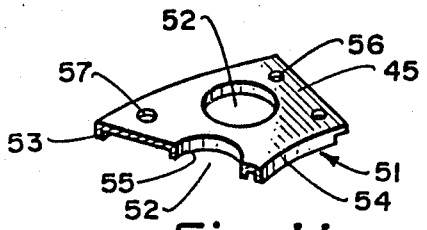
FIG. 11 is a perspective view of a portion of the baffle plate.
Figure 12:
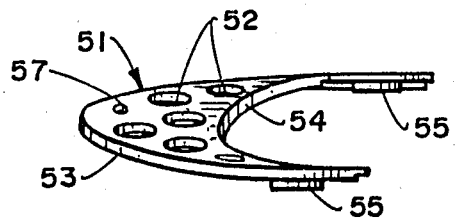
FIG. 12 is a front view in elevation of the baffle plate.

Similarly, as shown in FIG. 10, the stud 23 reams the excess material 43 in the central aperture to form a central hub 54 by reaming of the section 5 of the upper die 11. The diameter of the outer face 4 of the upper die is less than that of the cavity of the die guide by an amount predetermined to form clearance for bending to form an outer lip 53. The reaming results in 90° bending of the inner peripheral edge 43 and the outer peripheral edge of the plate as well as the edge of the tube apertures 42. These bent edges prevent the helically shaped plate 51 from springing back to a flat configuration and also provide ribs for attaching the baffle section to other baffle sections and to the central conduit and heat exchanger tubes. The baffle plate 51 is removed from the apparatus by sliding the form die 11 upwardly along the guide rods 24 by means of the arms of the plunger mechanism 32. Upon reaching the top of the limit of its movement, the upper form die actuates an automatic dropper mechanism, not shown, which knocks the formed helical baffle off the upper form die. Referring now to FIGS. 11 and 12, the manufacture of the baffle plate 51 is completed by stamping out on the edges 45 a seal rod hole 57 and rivet holes 56.

Figure 13:
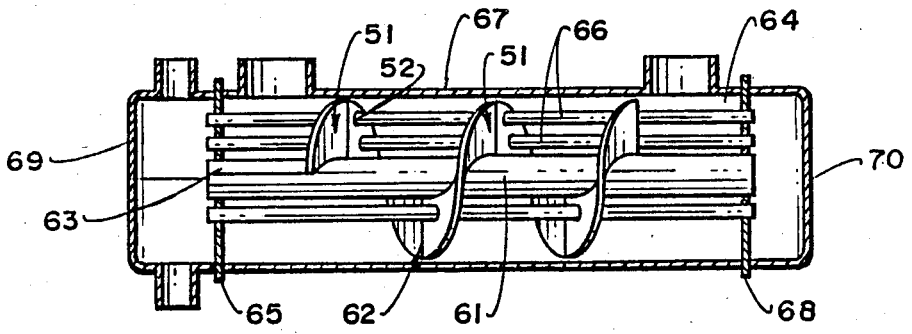
FIG. 13 is a longitudinal view of the tube bank containing the baffle of the invention shown with the face of the shell removed.

FIG. 13 is a schematic diagram of a multi-tube heat exchanger incorporating the baffle plate 51 manufactured by the above process of the invention. The heat exchanger is fabricated by first arranging the inner edge of the baffle 51 sections tighly along the center pipe 61 and rivetting the baffles together in series to form a helical baffle 62 of predetermined length. The guide plates 63, 64 extending in the direction of the center axis are attached at both ends of the baffle 61. The second step of fabrication includes attaching the tube sheet 65 at one end of the center pipe 61 and inserting the tubes 66 through the tube sheet 65 and the support holes 52 of the baffle plate 51 so as to be disposed in parallel position. The shell 67 is then fitted to the fabricated bundle to which the other tube sheet 68 is then attached, and, finally, the bonnets 69, 70 are installed to the outside of the tube sheets 65, 68 at both ends to complete the assembly.

The size of the plate material 41 can be any peripheral length as far as it is evenly divided and has a peripheral length of a partial circle less than one full pitch. The configuration of the tube apertures has to be such that a set of holes of each baffle plate should align along a common axis and be parallel to each other upon connecting the baffle plate 51 in series to form the helical plate 61. The baffle plates 51 may be welded together instead of rivetting which eliminates the need of extension edge 45.

The reaming process for the baffle plate may be simplified by eliminating the inner and outer edges 43, 44 and the base hole edges of the plate material by adjusting the inner and outer diameter and the base hole diameter of the plate material. The guide rod 24 which performs the secondary process of reaming the support hole 52 may be placed either on the lower or the upper form dies 1, 11.

As described above, this invention makes manufacturing of baffle plates extremely simple by sandwiching the plate material between the two forming dies since the circular plate material, having its circular periphery with less than one full pitch, is pressed to form a segment of a helix. The support holes on the plate material are formed first by piercing the base holes on the plate material and are then reamed during the secondary press process. The entire process consists of two processes, namely, one, to prepare the plate material by piercing the base holes on the plate and, two, to press forming the plate material prepared in the first process. Therefore, the baffle plates of any size, large or small, can be manufactured less expensively and more simply.

It is to be realized that only preferred embodiments of the invention have been described and that numerous substitutions, modifications and alterations are permissible without departing from the spirit and scope of the invention as defined in the following claims.

We claim:

1. A method of forming a baffle section for a shell and tube type heat exchanger comprising the steps of:

stamp forming a circular plate having less than a full circumference and containing a pattern of apertures corresponding to a heat exchange tube pattern by pressing the plate between two forming dies having opposed, helically shaped, mating surfaces to form a helically-shaped baffle section; and reaming said apertures to form a lip thereon.

2. A method according to claim 2 in which the plate contains a central hole for receiving a central conduit of a heat exchanger.

3. A method according to claim 2 in which the circular plate has a circumference of from 180° to 340° resulting from absence of a circular section.

4. A method according to claim 2 in which the lips are simultaneously formed during stamping.

5. A method according to claim 4 further including the step of simultaneously forming a lip on the edge of the central hole.

6. A method according to claim 5 further including the step of forming a lip on the outer edge of the plate.

7. A method according to claim 6 further including the step of joining helical sections together to form a helical baffle with each set of apertures aligned in each baffle along a common axis to receive a heat exchanger tube.

8. A method according to claim 7 in which said joining is effected by providing rivet holes at the leading and trailing edge of each section and rivetting the edges together.

* * * * *